United States Patent [19]

Swinson

[11] Patent Number: 4,871,218

[45] Date of Patent: Oct. 3, 1989

[54] COLLAPSIBLE STORAGE AND DISPLAY DEVICE

[76] Inventor: Owen I. Swinson, Rte. 2, Box 43A, Middletown, Ind. 47356

[21] Appl. No.: 110,326

[22] Filed: Oct. 20, 1987

[51] Int. Cl.[4] ..... A47B 57/00

[52] U.S. Cl. ..... 312/312; 211/55; 206/425; 312/244

[58] Field of Search ..... 312/312, 244; 211/55, 211/195; 206/425

[56] References Cited

U.S. PATENT DOCUMENTS

| | | | |
|---|---|---|---|
| D. 276,777 | 12/1984 | Evenson . | |
| 920,670 | 5/1909 | Scott | 211/55 |
| 987,625 | 3/1911 | Harris . | |
| 1,095,045 | 4/1914 | Timberlake | 211/195 |
| 1,618,386 | 2/1927 | Poole . | |
| 1,992,435 | 2/1935 | Labadie et al. . | |
| 2,224,794 | 3/1942 | Kitchen | 248/351 X |
| 2,397,306 | 3/1946 | Whipple | 312/244 X |
| 2,454,575 | 11/1948 | Silene . | |
| 2,772,003 | 11/1956 | Volz . | |
| 2,886,182 | 5/1959 | Dauman | 211/55 |
| 3,370,701 | 2/1968 | Van Acker et al. . | |
| 3,519,320 | 6/1968 | Freedman . | |
| 4,081,080 | 3/1978 | Rorex . | |
| 4,083,456 | 4/1978 | Genn t al. | 211/55 |
| 4,173,284 | 11/1979 | March . | |
| 4,444,314 | 4/1984 | Jacobsson | 206/425 |
| 4,613,047 | 9/1986 | Bushyhead et al. . | |

*Primary Examiner*—Joseph Falk
*Attorney, Agent, or Firm*—Woodard, Emhardt, Naughton, Moriarty & McNett

[57] ABSTRACT

A collapsible storage and display device includes a plurality of horizontally stacked bins cooperatively connected by forwardly extending side flanges to provide limited vertical sliding movement between each pair of adjacent bins. The forwardmost bin is anchored to a base. Lifting the rearwardmost bin relative to the base successively causes each bin to rise a predetermined distance and then lift the forwardly adjacent bin until the plurality of bins forms a horizontally stacked, stair-step display position. Pivoting support members are positioned to hold the device in the display position. A transport cover surrounds and protects the device and provides a means for carrying the device.

11 Claims, 4 Drawing Sheets

COLLAPSIBLE STORAGE AND DISPLAY DEVICE

FIELD OF THE INVENTION

The present invention relates to the field of display devices and more particularly to a collapsible device for the storage and display of sheet material and the like.

BACKGROUND OF THE INVENTION

The sale of sheet material, pamphlets and books is generally promoted by its display in stores or market vending areas or at conventions. Due to space considerations, the display of sheet material and the like generally requires a horizontally stacked, stair-step structure designed to show at least the top portion of each different article. A vendor of such items who carries his merchandise from one vending location to another will normally keep the merchandise in the display rack to avoid continual removal and restocking of the merchandise. This means that the vendor must manhandle an often large and bulky display rack. In addition, such display racks take up a great deal of space in both transport and storage. During transport and storage, some such display racks do not provide adequate protection for the merchandise they carry allowing dust and debris to enter or allowing the merchandise to spill out.

What is needed is a display and storage rack for sheet material and the like which provides good visual display of the merchandise, is easy to carry and will better protect the contents thereof.

SUMMARY OF THE INVENTION

Generally speaking there is provided a storage and display device for storing and displaying books, pamphlets, sheets and the like which erects from a compact storage position to a horizontally stacked, stair-step position. According to one embodiment each bin of a plurality of horizontally stacked bins includes a pair of forwardly extending side flanges which engage with the bin adjacently thereinfront to limit movement therebetween to vertical sliding movement. The forwardmost bin is anchored to a base. From a storage position wherein all the bins are horizontally stacked and aligned, the rearmost bin is lifted and each bin thereinfront is successively lifted a predetermined distance relative to the bin thereinfront until the plurality of bins forms a horizontally stacked, stair-step display position. A pivotal support member is engaged to hold the bins in the display position. A transport cover substantially encloses and protects the device and provides a convenient means for carrying the device.

It is an object of the present invention to provide an improved display device for sheet material and the like.

It is another object of the present invention to provide a convenient device both for displaying and for storing sheet material and the like.

It is still another object of the present invention to provide a device which is compact to carry yet which will still provide good visual display of the merchandise contained therein.

A further object of the present invention is to provide a display device which provides better protection for the contents thereof.

Further objects and advantages of the present invention will become apparent from the following description.

DESCRIPTION OF THE PREFERRED EMBODIMENT

Figure 1:
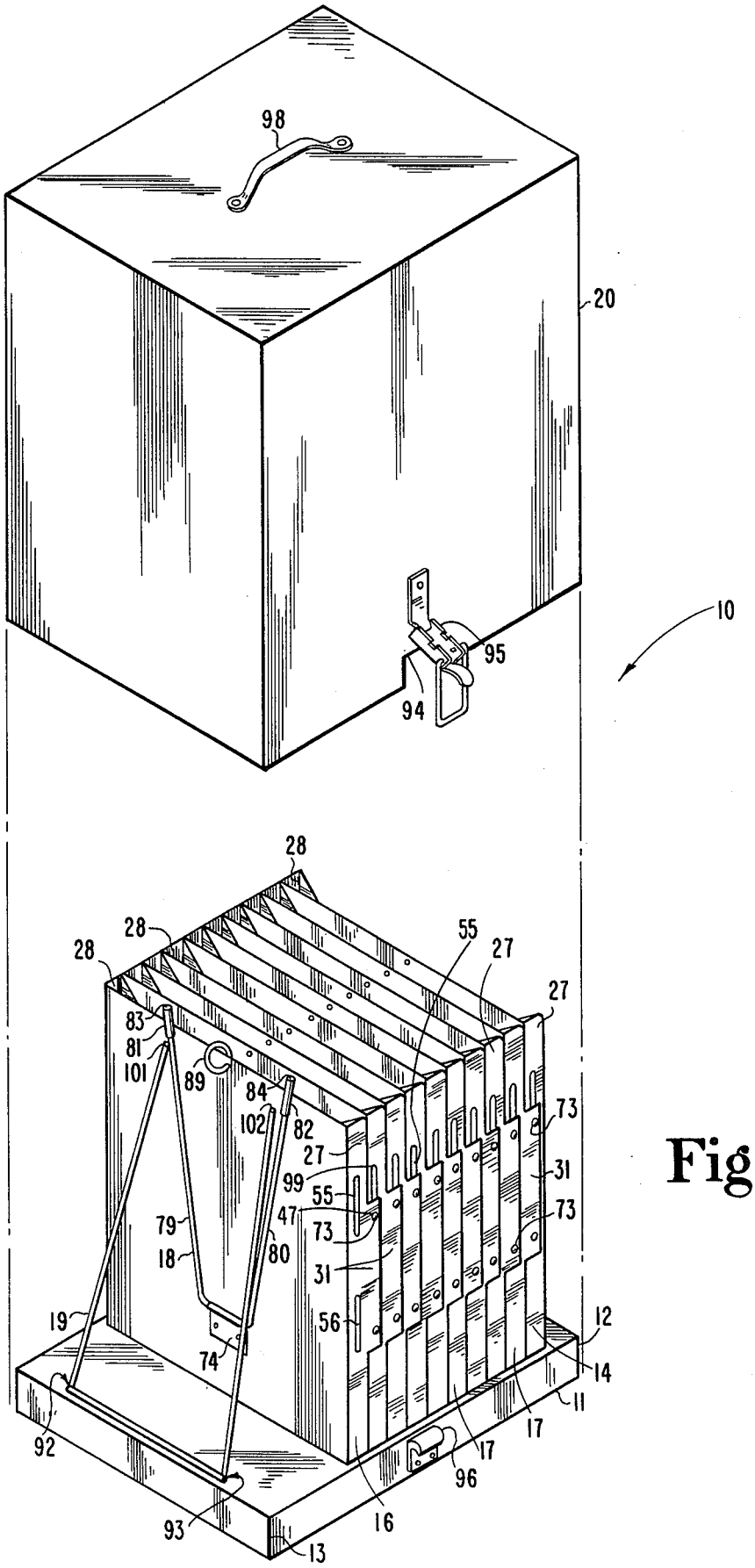
FIG. 1 is a rear perspective view of a collapsible storage and display device in the storage position in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is shown a collapsible storage and display device 10 in accordance with the preferred embodiment of the present invention. Device 10 includes a base 11, a front bin 14, a rear bin 16, intermediate bins 17, upper and lower support members 18 and 19, and a transport cover 20.

Figure 2:
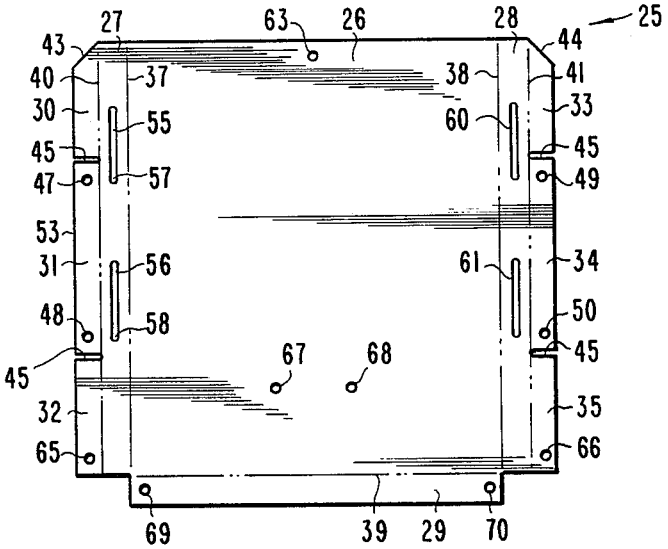
FIG. 2 is a top plan view of a blank for forming a single bin of the collapsible storage and display device of FIG. 1.

Each of the bins 14, 16 and 17 is formed from an identical blank 25 of 26 gauge sheet metal. (FIG. 2) Blank 25 of FIG. 2 is shown with layout lines indicating the axes of bending between various sections of blank 25 for the formation of a finished bin. A central rectangular panel 26 is delimited from first and second rectangular side panels 27 and 28 by longitudinal lines 37 and 38, respectively. Bottom rectangular panel 29 is delimited from central panel 26 by horizontal line 39. Longitudinal line 40, which is parallel to line 37, delimits side panel 27 from upper, middle and lower panels 30, 31 and 32, respectively. Likewise, longitudinal line 41, which is parallel to line 38, delimits side panel 28 from upper, middle and lower panels 33, 34 and 35, respectively. Slot-like cutouts 45 divide panel 30 from 31, panel 31 from 32, panel 33 from 34 and panel 34 from 35. Each cutout 45 extends inwardly and slightly across its adjacent longitudinal line 40 or 41. This allows, for example, upper panel 30 to be bent relative to side panel 27 along longitudinal line 40 without movement of middle panel 31. The top of each upper panel 30 and 33 is beveled off at 43 and 44, respectively at a 45° angle. At the top and bottom of middle panel 31 are defined upper and lower vertically aligned holes 47 and 48, respectively. Likewise, at the top and bottom of middle panel 34 are defined identical upper and lower vertically aligned holes 49 and 50. The width of middle panel 31, measured between outer edge 53 and longitudinal line 40, is less than the width of side panel 27, measured between line 40 and line 37. Likewise, the width of middle panel 34 is less than the width of side panel 28. Upper and lower vertically aligned slots 55 and 56 are defined in side panel 27. Hole 47 is horizontally aligned with or slightly higher than the bottom portion 57 of slot 55 and hole 48 is horizontally aligned with or slightly higher than the bottom portion 58 of slot 56. Side panel 28 likewise defines upper and lower vertically aligned slots 60 and 61 with holes 49 and 50 being aligned with or slightly higher than the bottom portions of slots 60 and 61, respectively. Slots, 55, 56, 60 and 61 are identical with each other and each has a height equal to no more than 25% of the height of central panel 26. In the preferred embodiment, each slot has a height equal to approximately 18% of the height of central panel 26. Holes 65 and 66 are defined in and near the bottom of lower panels 32 and 35, respectively. Central panel 26 defines two central, lower and mutually proximal holes 67 and 68 and an upper, central hole 63. Holes 69 and 70 are defined in and at opposing ends of bottom panel 29 as shown in FIG. 2.

Figure 3:
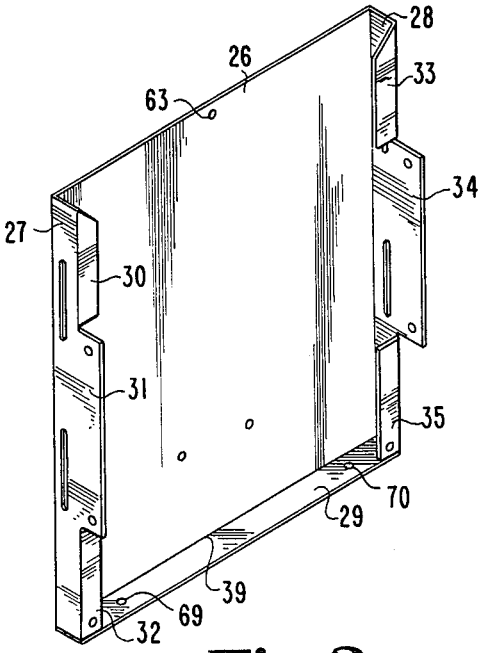
FIG. 3 is a front perspective view of a bin formed from the blank of FIG. 2.

Rear bin 16 and intermediate bins 17 (FIG. 1) are identical to one another and are each formed from blank 25 (horizontally positioned in FIG. 2) by first bending upper panel 30 and lower panel 32 upward 90° relative to side panel 27 and along layout line 40, leaving middle panel 31 in the same plane with side panel 27. Likewise, upper panel 33 and lower panel 35 are bent upwardly 90° relative to side panel 28 and along layout line 41 leaving middle panel 34 in the same plane as side panel 28. Side panels 27 and 28 are then both bent upwardly 90° relative to central panel 26 and along lines 37 and 38, respectively. As shown in FIG. 3, upper panels 30 and 33 and lower panels 32 and 35 are now coplanar and extend 90° from their adjacent side panels 27 and 28, respectively, and toward each other while middle panels 31 and 34 form flanges extending parallel to one another and orthogonally upward from central panel 26. Bottom panel 29 is bent upward 90° relative to central panel 26 and along line 39 to form a bottom for the bin.

Figure 5:
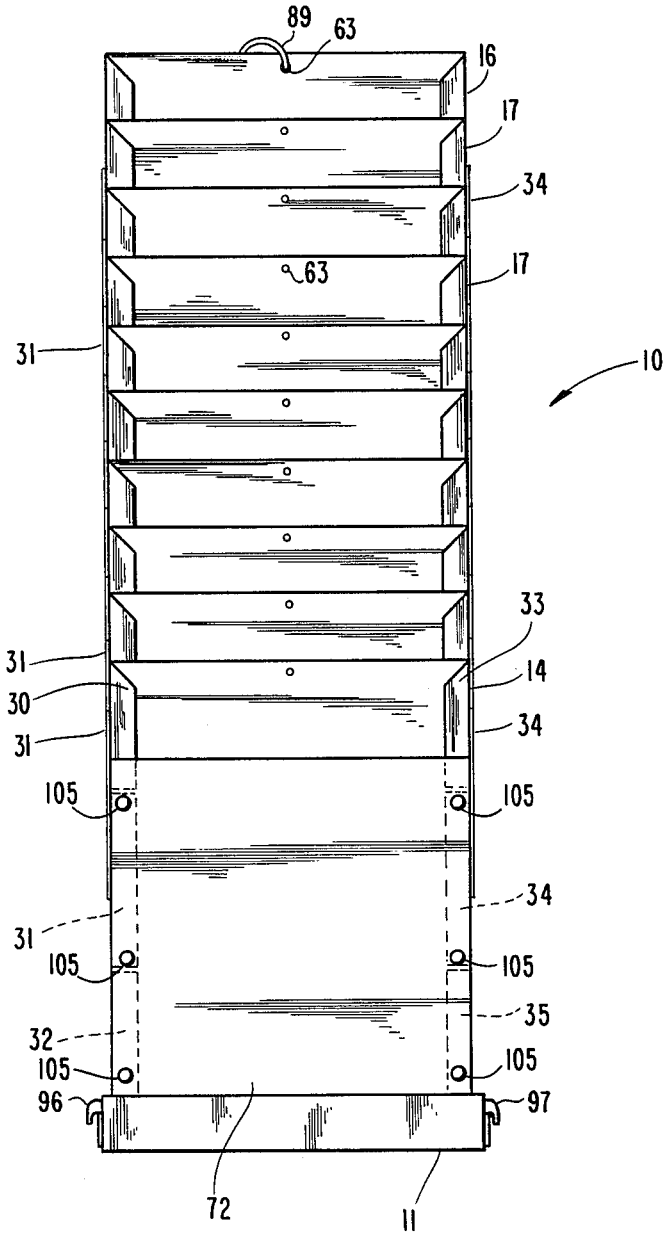
FIG. 5 is a front elevational view of the storage and display device of FIG. 4.

Front bin 14 is formed as described above except that middle panels 31 and 34 are bent along with upper panels 30 and 33 and lower panels 32 and 35 along lines 40 and 41 to form coplanar, inwardly extending flanges to which is secured front plate 72. (FIG. 5)

The bins behind front bin 14 are horizontally stacked, as shown in FIG. 1, with the forwardly extending middle panels 31 and 34 of each bin deforming slightly apart and overlapping the sides 27 and 28, respectively, of the bin adjacently thereinfront. Slots 55, 56, 60 and 61 are situated in sides 27 and 28 and holes 47, 48, 49 and 50 are situated in middle panels 31 and 34 such that when the panels 31 and 34 of one bin overlap corresponding sides 27 and 28 of the forwardly adjacent bin, hole 47 of the one bin aligns with slot 55 of the forwardly adjacent bin. And, when display device 10 is in the storage position (as shown in FIG. 1), Hole 47 of one bin aligns at the bottom portion 57 of slot 55 of the forwardly adjacent bin. Holes 48, 49 and 50 of one bin align in the same manner with slots 56, 60 and 61, respectively, of the bin adjacently thereinfront. Front bin 14 is nested between the middle panels 31 and 34 of the forwardmost intermediate bin 17. Appropriate pin members such as rivets 73 are fastened through each hole-slot match-up (such as hole 47 and slot 55), limiting movement of each bin behind front bin 14, relative to the bin adjacently thereinfront, to vertical sliding movement a distance equal to the height of one of the identically sized slots.

Each bin forward of rear bin 16 rests against the bin adjacently therebehind with the back of the central panel 26 resting against panels 30, 32, 33 and 35 (FIG. 3) of the rearwardly adjacent bin. The cavity for receiving sheet material and the like is thus defined by central panel 26, sides 27 and 28 and panels 30, 32, 33 and 35 of one bin and by the back of the central panel 26 of the forwardly adjacent bin. In the case of the cavity provided by front bin 14, the back of the central panel 26 of a forwardly adjacent bin is replaced by front plate 72 (FIG. 5) which is secured to front bin 14 by rivets 105 through holes 47, 48, 65, 49, 50 and 66 of front bin 14. (FIG. 2)

Figure 4:
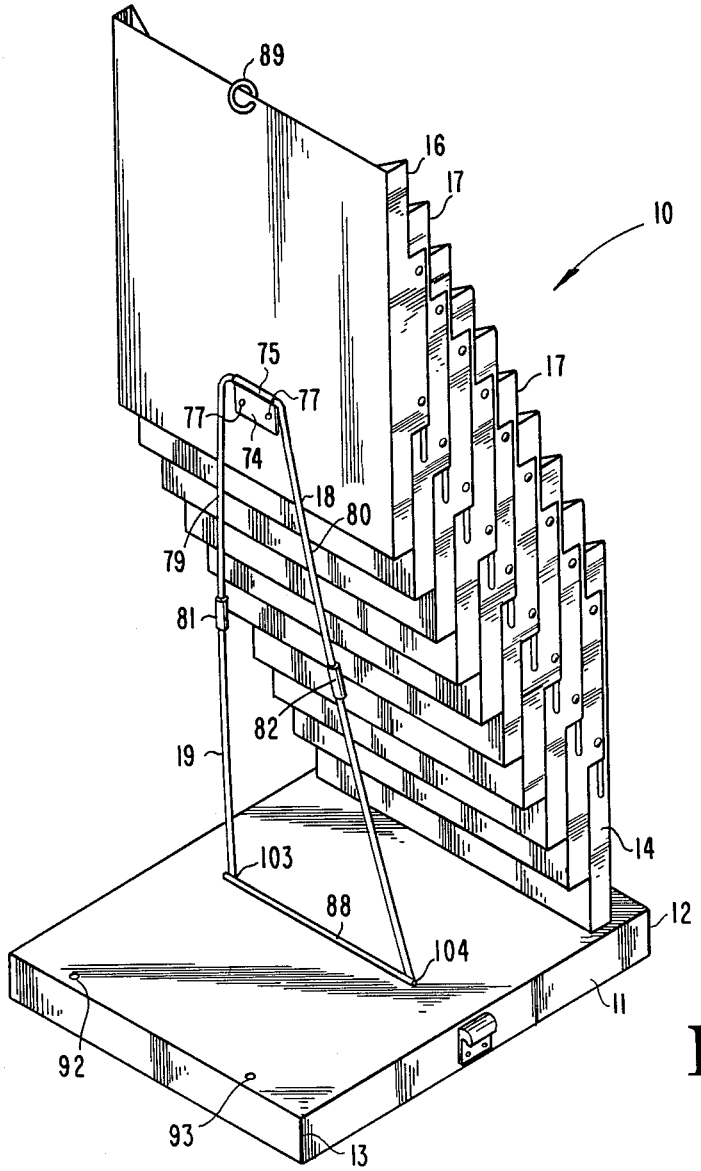
FIG. 4 is a rear perspective view of the collapsible storage and display device of FIG. 1 in the display position.

Base 11 is slightly wider than the bins and is several inches longer than the total depth of all of the horizontally stacked bins, the excess length providing stability when display device 10 is in the display position shown in FIG. 4. Base 11 defines a pair of forward holes (not shown) which correspondingly align with holes 69 and 70 (FIG. 3) of front bin 14 when the set of horizontally stacked bins is situated in the desired position upon base 11, that position being substantially closer to the front 12 of base 11 than to the rear 13 as shown in FIG. 1. The set of horizontally stacked bins are anchored to base 11 by appropriate fasteners such as rivets (not shown) which pass through holes 69 and 70 of bottom panel 29 of front bin 14 and through the corresponding holes (not shown) in base 11.

Upper support member 18 is pivotally secured to the back of rear bin 16 by bracket 74 (FIGS. 1 and 4). Rivets 77 secure bracket 74 to rear bin 16 via holes 67 and 68 of central panel 26 (FIG. 2). Bracket 74 includes a cylindrical portion 75 through which extends a horizontal segment of member 18 allowing upper support member 18 to pivot relative to rear bin 16. External of cylindrical portion 75, upper support member 18 includes a pair of diverging rod segments 79 and 80. Rigidly secured to the end of each rod segment 79 and 80 is a sleeve member 81 and 82, respectively, each sleeve member forming an open ended cavity or female connection 83 and 84 (FIG. 1).

Figure 6:
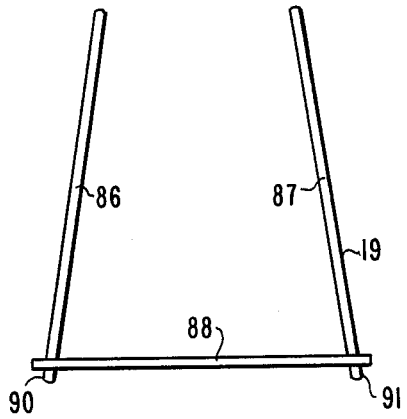
FIG. 6 is a rear elevational view of the lower support member of the storage and display device of FIG. 1.

As shown in FIG. 6, lower support member 19 includes a pair of downwardly diverging rods 86 and 87 and a cross bar 88 rigidly secured to each rod 86 and 87 by appropriate means such as welds. Cross bar 88 is secured to rods 86 and 87 so as to leave a $\frac{1}{4}$ inch anchor post 90 and 91 at the bottom of each rod 86 and 87, respectively, and below cross bar 88.

Finger ring 89 is secured through hole 63 in rear bin 16 to aid in manual erection of display device 10.

In the storage position shown in FIG. 1, all of the bins 14, 16 and 17 rest in a horizontally stacked position atop base 11. Each rivet 73 is situated at the bottom of its corresponding slot 55 and 56 (and 60 and 61 not shown in FIG. 1). Upper support member 18, pivotally anchored by bracket 74, is pivoted upwards and rests flat against the back of rear bin 16. Lower support member 19 is stored therebehind with its anchor posts 90 and 91 inserted through a pair of appropriately spaced holes 92 and 93 in base 11 (see FIG. 4). Cross bar 88 acts as a stop to support lower member 19 upon base 11. Transport cover 20 fits completely around the bins, support members and the base. A pair of rectangular cutouts 94 (one shown) are defined, one each in the bottom of opposing sides of cover 20. A conventional clasp 95 is mounted just above each of the two cutouts 94. Cover 20 surrounds the outer sides of base 11 and is supported vertically via cutouts 94 upon a pair of corresponding hooks 96 and 97 (see FIG. 5). Cover 20 is secured to base 11 by locking clasps 95 (one shown in FIG. 1) onto corresponding hooks 96 and 97. With cover 20 secured to base 11, the entire display device 10 may be easily transported by handle 98, with the vendor's merchandise resting securely in the bins within the cover 20.

To erect display device 10 into the display position, clasps 95 are unhooked and cover 20 is removed. With base 11 anchored by the operator's foot, finger ring 89 is grasped and pulled upward thus pulling rear bin 16 upward. Rear bin 16 slides upward relative to the forwardly adjacent bin 17. The rivets 73, fixed within the holes in the flanges 31 and 32 of rear bin 16, follow the slots of the forwardly adjacent bin 17 until the top 99 (FIG. 1) of the respective slot is reached. There, bin 16 will no longer slide upward relative to forwardly adjacent bin 17 but will lift it. As rear bin 16 is lifted further, each bin 17 forward thereof will thus slide and then lift the forwardly adjacent bin 17 until anchored front bin 14 is reached. Bins 14, 16 and 17 will form a horizontally stacked, stair-step configuration shown in FIGS. 4 and 5. Upper support member 18 is pivoted downward, lower support member 19 is removed from its rest position in holes 92 and 93 (FIG. 1) and male or upper ends 101 and 102 (FIG. 1) of lower support member 19 are inserted into cavities 83 and 84 of corresponding sleeve members 81 and 82, respectively. The upper and lower support member combination 18 and 19 is pivoted at cylindrical portion 75 and is deformed slightly to bend underneath bins 16 and 17. Anchor posts 90 and 91 are then dropped into a pair of holes at 103 and 104, respectively, in base 11. The holes at 103 and 104 are vertically below the first or second bin 17 forward of rear bin 16 so that upper and lower support member combination 18 and 19 must be buckled slightly to engage with the holes at 103 and 104. This creates a tighter, more stable engagement among all the components of display device 10.

Further embodiments are contemplated wherein the bins are made of a plastic or fiberglass or similar material.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A storage and display device for storing and displaying books, pamphlets, sheets and the like, comprising;

a base;

a plurality of horizontally stacked bins including a front bin anchored to said base, a rear bin and at least one intermediate bin, each bin connected for limited vertical sliding movement with each adjacent bin;

wherein the storage and display device has a storage position wherein all of said bins are resting in horizontal alignment from front to back upon said base;

wherein the storage and display device has a display position reached from said storage position by lifting the rear bin from said base, the rear bin and successively each bin thereinfront pulling the bin adjacently thereinfront upward until each bin behind the front bin is higher than the bin adjacently thereinfront;

wherein each bin behind the front bin has a pair of opposed, parallel and forwardly extending side flanges, and wherein each bin in front of the rear bin nests entirely horizontally between the side flanges of and adjacent to the bin therebehind;

wherein each bin in front of the rear bin is slidably connected to the forwardly extending side flanges of the bin immediately therebehind to permit motion therebetween only between said storage position and said display position;

wherein the storage and display device further comprises support means, connected between the rear bin and said base, for holding the display device in said display position; and, wherein each side of each bin defines a pair of vertically extending slots and each flange defines a pair of holes, the pair of holes of one flange aligning with the pair of slots of the corresponding side of the bin thereinfront, the display device further including pins, each pin extending through one hole and one corresponding slot and keeping the one corresponding hole aligned with the one corresponding slot.

2. The storage and display device of claim 1 wherein each bin is formed from an identical flat blank defining:

a central rectangular section having a first width and first height, a bottom and two opposing sides;

a bottom rectangular section delimited from the bottom of the central section by a horizontal line and having a width equal to the width of the central section and having a height;

first and second identical rectangular side sections, each delimited from one of the two opposing sides by first and second longitudinal lines, each side section having a width equal to the height of the bottom section and having a height equal to the height of the central section; and, third and fourth identical generally rectangular side sections, each delimited from said first and second side sections, respectively, by third and fourth longitudinal lines, said third and fourth sections each being subdivided into upper, middle and lower generally rectangular sections by transverse cuts, each middle section defining a top hole and a bottom hole, the first and second side section each defining a top vertical slot and a bottom vertical slot, the top hole being horizontally aligned with the bottom of the top slot and the bottom hole being aligned with the bottom of the bottom slot.

3. The storage and display device of claim 2 wherein each flat blank is made of sheet metal.

4. The storage and display device of claim 2 wherein each slot of each blank has a height equal to less than 25% of the first height.

5. The storage and display device of claim 4 wherein each slot of each blank has a height of approximately equal to 18% of the first height.

6. The storage and display device of claim 4 wherein each bin is formed from the flat blank by bending the upper sections and the lower section 90° upward relative to the first and second side sections, by bending the first and second side sections 90° upward relative to the central section and by bending the bottom section 90° upward relative to the central section.

7. A storage and display device for storing and displaying books, pamphlets, sheets and the like, comprising:

a base;

a plurality of horizontally stacked bins including a front bin anchored to said base, a rear bin and at least one intermediate bin, each bin connected for limited vertical sliding movement with each adjacent bin;

wherein the storage and display device has a storage position wherein all of said bins are resting in horizontal alignment from front to back upon said base;

wherein the storage and display device has a display position reached from said storage position by lifting the rear bin from said base, the rear bin and successively each bin thereinfront pulling the bin adjacently thereinfront upward until each bin behind the front bin is higher than the bin adjacently thereinfront;

wherein each bin behind the front bin has a pair of opposed, parallel and forwardly extending side flanges, and wherein each bin in front of the rear bin nests entirely horizontally between the side flanges of and adjacent to the bin therebehind;

wherein each bin in front of the rear bin is slidably connected to the forwardly extending side flanges of the bin immediately therebehind to permit motion therebetween only between said storage position and said display position;

wherein the storage and display device further comprises support means, connected between the rear bin and said base, for holding the display device in said display position; and, wherein the rear bin includes a rear wall having a rear surface and wherein said support means includes a first support member pivotally mounted to the rear wall and wherein said support means further includes a second support member adapted to be anchored to and between both said base and the first support member to hold said bins in the display position.

8. The storage and display device of claim 7 wherein the first support member includes a pair of rods each pivotally connected at one end to the rear bin and each of the rods having an opposite end having one of a female and a male connection, and wherein the second support member includes a pair of rods each having the other of a female and a male connection for joining with the opposite end of a corresponding rod of the first support member.

9. The storage and display device of claim 8 wherein said base defines a first pair of transversely aligned storage holes for holding the second support member behind the rear bin in the storage position and wherein said base defines a second pair of transversely aligned support holes for holding the second support member in the display position, the second pair of support holes being situated below and horizontally between the front bin and the rear bin.

10. The storage and display device of claim 1 further including a transport cover releasably lockable to said base, said transport cover sized to completely cover said bins and including a carrying handle fixed to the outside thereof.

11. A method for forming a collapsible storage and display device, comprising the steps of:

providing a plurality of identical blanks, each blank including:

a central rectangular section having a first width and first height, a bottom and two opposing sides, a bottom rectangular section delimited from the bottom of the central section by a horizontal line and having a width equal to the width of the central section and having a height, first and second identical rectangular side sections, each delimited from one of the two opposing sides by first and second longitudinal lines, each side section having a width equal to the height of the bottom section and having a height equal to the height of the central section, and third and fourth identical generally rectangular side sections, each delimited from said first and second side sections, respectively, by third and fourth longitudinal lines, said third and fourth sections each being subdivided into top, middle and lower generally rectangular sections by transverse cuts, each middle section defining a top hole and a bottom hole, the first and second side section each defining a top vertical slot and a bottom vertical slot, the top hole being horizontally aligned with the bottom of the top slot and the bottom hole being aligned with the bottom of the bottom slot;

forming a plurality of bins from the blanks by bending the top and lower sections of each blank 90° upward relative to the first and second side sections, by bending the first and second side sections of each blank 90° upward relative to the central section whereby the middle sections form a pair of upwardly extending and parallel side flanges and by bending the bottom section of each blank 90° upward relative to the central section;

horizontally stacking the bins front to back, each bin in front of the rearmost bin nesting against and between the flanges of the bin adjacently therebehind, whereby each of the holes of each bin behind the frontmost bin align with a corresponding one of the slots of the bin adjacently thereinfront;

securing a pin member through each hole and corresponding adjacent slot;

providing a base beneath the stacked bins;

anchoring the frontmost bin to the base;

providing means for lifting the rearmost bin upwards relative to the base whereby each bin in front of the rearmost bin and behind the frontmost bin is lifted to a display position by the bin adjacently therebehind; and, providing means between the rearmost bin and the base for holding the bins in the display position.

* * * * *